United States Patent [19]

Weissner

[11] Patent Number: 5,025,513

[45] Date of Patent: Jun. 25, 1991

[54] POOL COVER WITH COMPRESSIBLE SAFETY EDGE

[75] Inventor: David W. Weissner, Hicksville, N.Y.

[73] Assignee: Meyco Products Inc., Hicksville, N.Y.

[21] Appl. No.: 496,606

[22] Filed: Mar. 21, 1990

[51] Int. Cl.[5] ..... E04H 4/10

[52] U.S. Cl. ..... 4/498; 4/504

[58] Field of Search ..... 4/496, 580, 498–504; 52/222; 264/DIG. 10, DIG. 16, DIG. 83, DIG. 84

[56] References Cited

U.S. PATENT DOCUMENTS

| | | | |
|---|---|---|---|
| 2,958,872 | 11/1960 | Meyer, Jr. | 4/503 |
| 3,042,161 | 7/1962 | Meyer, Jr. | 52/166 |
| 3,676,880 | 7/1972 | Kwake | 4/503 X |
| 3,889,303 | 6/1975 | Kinzel | 4/501 |
| 3,927,427 | 12/1975 | Aine | 4/499 |
| 4,122,561 | 10/1978 | Barr | 4/499 |
| 4,251,889 | 2/1981 | Lof | 4/498 |
| 4,497,152 | 2/1985 | Weissner | 52/709 |
| 4,526,736 | 7/1985 | Searl et al. | 264/DIG. 16 |
| 4,953,239 | 9/1990 | Gadsby | 4/499 |

FOREIGN PATENT DOCUMENTS

| | | | |
|---|---|---|---|
| 2100716 | 7/1971 | Fed. Rep. of Germany | 4/501 |
| 2638192 | 3/1978 | Fed. Rep. of Germany | 4/498 |

*Primary Examiner*—Henry J. Recla
*Assistant Examiner*—Casey Jacyna
*Attorney, Agent, or Firm*—Brumbaugh, Graves, Donohue & Raymond

[57] ABSTRACT

A pool cover has a compressible safety edge providing resilient conformance to obstructions over a wide range of atmospheric and loading conditions. Pool covers can be stretched over the water surface of a swimming pool, extending securely onto the surrounding apron except in the area of poolside obstructions. A safety edge may include a resilient compressible foam core supported and protected by a tough flexible fabric enclosure attached to the edge of the pool cover so as to be held against and conform to the obstruction to secure the opening. Solid or hollow foam cylinders of different shapes may be used and forms of extruded plastic elements are shown.

14 Claims, 2 Drawing Sheets

POOL COVER WITH COMPRESSIBLE SAFETY EDGE

BACKGROUND OF THE INVENTION

Applicant's assignee has for many years designed, manufactured and sold safety pool covers of the type in which a cover of a strong mesh fabric reinforced by attached webbing strips is held taut over the water surface of a swimming pool by compression springs coupling the strips to anchors embedded in the concrete or other deck surface surrounding the pool. These covers are normally suspended above the entire water surface and extend beyond the edge of the pool about 12 to 18 inches onto the surrounding apron or deck surface so that there are no openings providing access to the water through which children or debris can fall or become lodged. The covers are designed to support the weight of a person and, in actual incidents, have supported lawn tractors, cows and even a car, without structural failure. While the mesh construction permits rain to drain through the cover, in winter a snow load of very considerable weight may build up and the cover must provide protection under such conditions. See, for example, U.S. Pat. No. 2,958,872 to Meyer, assigned to the same assignee, which shows and describes this type of pool cover.

These pool covers continue to provide excellent service and safety for the majority of pool applications. However, a problem which has existed for a long period without any satisfactory solution is now becoming more significant.

Swimming pools in previous years were predominantly rectangular or incorporated only simple outlines, with the entire pool edge at the same elevation above the water surface. This permitted mesh safety covers to easily overlap the peripheral coping surface surrounding the pool. Not only were dangerous openings avoided, but wind-blown debris was prevented from contaminating the pool water. However, more recently architects and pool designers have increasingly incorporated more sophisticated design elements such as slides, rough surface waterfalls, multi-level copings, steps to raised level spas, vertical walls, overhanging diving rocks, etc. All of these design features can represent obstructions, typically including a structure extending vertically higher than the basic peripheral coping surface, which prevent a pool cover from being stretched across the pool edge to provide an overlap at the location of the obstruction. As a result, an effort has usually been made to fit the pool cover around the vertical obstruction. However, without a securely fastened overlap, the fit of the cover to the obstruction can leave a gap whose size is dependent on the accuracy in measuring the pool, original cover tailoring, accuracy of cover installation, displacements after cover installation, etc. For example, a heavy snow load temporarily pulling the cover away from pool edges can cause an enlarged opening or gap between the cover and an obstruction. At irregularly shaped obstructions a particularly dangerous condition can result.

A further demand for closer fitting covers has been introduced by the issuance of a Consumer Product Safety Commission sponsored, and ASTM drafted, Emergency Standard for Safety Swimming Pool Covers intended to reduce child drownings (American Society of Testing Materials standard ES-13). This Standard mandates the absence of any openings large enough to permit a small child's head from gaining access to the water, specifically providing for:

Perimeter Deflection Test-With a weight of 50 lbs. on the cover at a distance of at least 4 ft. (but not exceeding 6 ft.) the cover shall not deflect away from the pool enough to allow a perimeter test object (an ellipsoidal 3.7"×5.7" and 36.6 lbs. weight object), to gain access to the water.

Openings Test-No opening shall exist between the edge of the cover and the deck surface and coping wall or both or the top surface of the spa or pool, large enough to permit a solid-faced spherical test object with a maximum breadth of 4.5" and a steadily applied force of 40±1 lbs. to pass through to the water.

Previous attempts to solve this problem have not provided a satisfactory solution in general, and particularly with respect to reliably securing openings at irregularly-shaped obstructions and to maintaining secure closure under disruptive conditions such as heavy snow loading. Prior attempts have included waterbag pillows, extra flaps of pool cover material or plastic-flaps, which have generally been too difficult or costly to install, aesthetically unattractive and ineffective to a greater or lesser degree. For example, use of plastic flaps at obstructions is subject to the difficult requirements that the flap must simultaneously be rigid enough to securely close a gap, flexible enough to shape itself to the contour of the obstruction and must maintain both these contradictory characteristics at low temperature conditions so as to readily adapt to changing snow loads in the middle of the winter. It should be noted that while certain prior approaches may be suitable for application to specific forms of obstructions under static conditions, a satisfactory solution must provide secure closure of openings for a wide range of structural shapes and installations, under dynamic variations of loading, temperature and other environmental conditions.

It is, therefore, an object of this invention to provide a pool cover having a compressible safety edge for resiliently filling openings between pool cover edges and obstructions.

It is a further object to provide a swimming pool safety system in which spring assemblies couple the pool cover to poolside anchors so that the compressible safety edge is held in place at an obstruction to resiliently secure the opening during both static and changing load conditions.

SUMMARY OF THE INVENTION

In accordance with the present invention, a pool cover having a compressible safety edge for resiliently filling openings adjacent to vertical obstructions includes a flexible cover configured to cover a pool in secure overlapping relationship to the pool edges except in the vicinity of an obstruction. The flexible cover may be porous or mesh plastic material with fastening means such as webbing strips attached to it transversely and at the edges. Resilient compressible means, conformable to an obstruction, for resiliently filling the interface between the edge of the cover and an obstruction of regular or irregular shape so as to leave only limited openings, are held in place by support means configured for attachment to the edge of the cover for supporting the resilient compressible means. As a result, on installation of the pool cover the safety edge is held in place adjacent to an obstruction so as to resiliently secure the interface between the pool cover and the obstruction during both static conditions and loading conditions tending to separate the cover from the obstruction.

DESCRIPTION OF THE INVENTION

Figure 1:
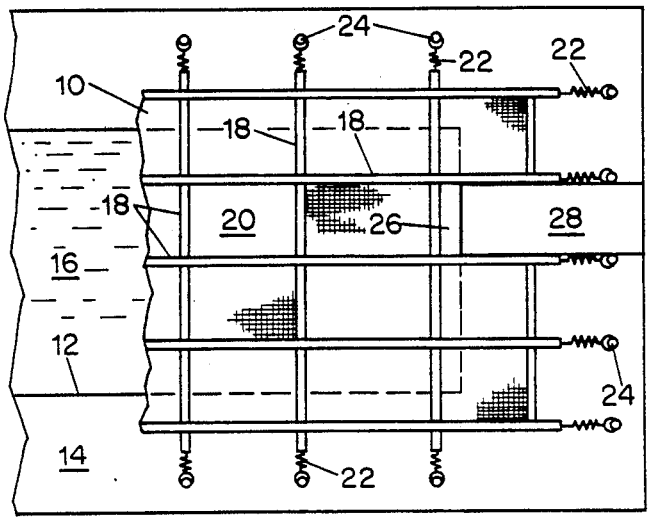
FIG. 1 is a plan view of a pool cover in accordance with the invention installed over a swimming pool with a poolside obstruction.

Referring now to FIG. 1, there is shown a plan view of a pool cover 10 in accordance with the present invention installed on a swimming pool having walls 12, surrounding poolside surface 14 and a water surface 16. Poolside surface 14 may represent a coping at pool edge, plus a surrounding apron of concrete, stone or brick, or a wooden deck. Pool cover 10 as shown includes a flexible cover 20, which can be of a strong plastic mesh or porous fabric. The cover also includes fastening means for holding the pool cover in place over the pool, shown as webbing strips 18 and spring assemblies 22. Strips 18 can be plastic fabric straps securely sewn to the cover 20 at its edges transversely to form a grid pattern as shown. At the ends of the transverse strips 18 are connected spring assemblies 22 which may include corrosion resistant metal springs arranged to act in compression on being coupled to anchors 24 set into surface 14. U.S. Pat. No. 2,958,872 referred to above shows a suitable form of spring assembly that can be used. The pool cover is installed by extending the ends of the spring assemblies for attachment to the anchors 24 so as to pull and hold the strips 18 and cover fabric 20 taut, stretching the pool cover across the pool over the water surface. U.S. Pat. No. 3,042,161 to Meyer and applicant's U.S. Pat. No. 4,497,152 shows suitable forms of anchors for use in concrete and wood surfaces, respectively.

Figure 2:
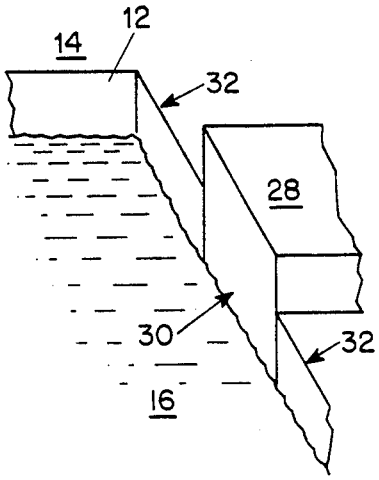
FIG. 2 is a perspective view of a portion of the FIG. 1 pool in the vicinity of the obstruction.

In order to more particularly describe the compressible safety edge 26 on the pool cover 10, reference is made to FIG. 2, which is a perspective view of a portion of the FIG. 1 pool structure in the vicinity of obstruction 28 with the pool cover removed. As shown in FIG. 2, the obstruction in this example is a stone block 28 extending above the poolside surface 14 and having a vertical surface 30, shown as flush with the pool walls 12, but presenting a vertical obstruction above surface 14 at the pool edge. As a result, the pool cover can readily overlap the pool edge in the areas of the arrows 32, but not at the surface 30 of block 28 which presents a vertical obstruction. Thus, as shown in FIG. 1, the flexible cover fabric 20 is configured to cover the pool in secure overlapping relationship to the edges of the pool except in the vicinity of the obstruction represented by block 28. In other installations an obstruction may protrude beyond the edge or be set back and the face of the obstruction may be rough, convex, concave, slanted, or otherwise irregular.

Figure 3:
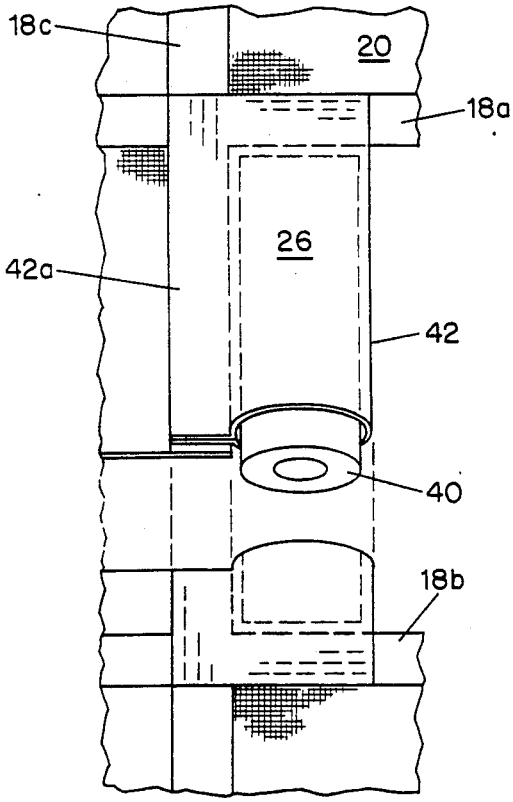
FIG. 3 is an expanded view of a portion of the FIG. 1 pool cover showing details of the compressible safety edge in accordance with the invention.

In FIG. 1, the opening which would otherwise exist between the cover fabric 20 and the block 28 is filled by the resilient safety edge 26 which resiliently fills the opening. The safety edge 26 of FIG. 1 is shown in greater detail in FIG. 3, which is an expanded view of a portion of the FIG. 1 cover 10 in the immediate vicinity of safety edge 26. In FIG. 3 is shown the flexible mesh cover fabric 20 in which a cut-out to fit around block 28 of FIG. 1 has been bounded by webbing straps 18*a, b* and *c* sewn to the mesh fabric 20 around the edges of the cut-out (and continuing transversely across the fabric). Safety edge 26 as shown in FIG. 3 has been cut to expose resilient compressible means 40, shown as a section of a hollow foam cylinder. The foam cylinder 40 is within support means 42, shown as a section of weather and abrasion resistant fabric sheeting enclosing, protecting and supporting compressible cylinder 40. As shown, support means 42 is in the form of a rectangular fabric section large enough so that when folded in half the cylinder 40 can be inserted into the fold so as to be covered with enough extra fabric to extend beyond cylinder 40 to provide the doubled edge portion 42*a* extending at both ends and along the side of the cylinder 40. The double layer frame portion 42*a* of the support cover 42 can then be securely stitched to the webbing strips 18*a, b* and *c* adjacent to the ends and side of foam cylinder 40.

Referring back to FIG. 1, it will now be apparent that the safety edge 26 is held in place adjacent to the vertical face of block 28 by the action of the spring assemblies 22 pulling on the webbing strips 18. As a result, the combination of resilient compressible foam cylinder 40 supported by the support enclosure fabric 42 resiliently fills and secures the opening which would otherwise exist at the interface between the pool cover and the obstruction. While other embodiments may be used, in this arrangement the foam cylinder provides a compressibility which permits a secure conformance to obstructions of regular or irregular shape with the resilience to also adjust to changes in position of the pool cover relative to the obstruction in the presence of snow loading, for example. The support enclosure fabric 42, which can be a section of weather and abrasion resistant, polymer-coated fabric sheeting, protects and holds the foam cylinder 40 in position under the control of the spring assemblies. In this way the safety edge resiliently secures the opening at the obstruction during both static conditions and pool cover loading conditions which can exist when persons, objects or snow on the pool cover cause it to tend to be pulled back so as to separate the cover from the obstruction. Further, the physical characteristics of the resilient compressible means 40 and support means 42 can be collectively chosen to provide combined properties of firm compressibility, with resiliency maintained under wide variations of temperature and other atmospheric conditions, so that the safety edge can expand and compress to maintain secure closure of the interface.

Figure 4:
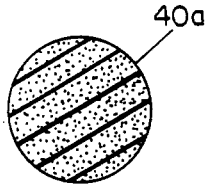
FIG. 4 is a cross-sectional view of an alternative form of foam cylinder 40 in FIG. 1
Figure 5:
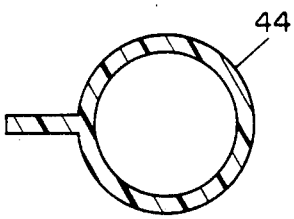
FIG. 5 is a cross-sectional view of an extruded safety edge element.
Figure 6:
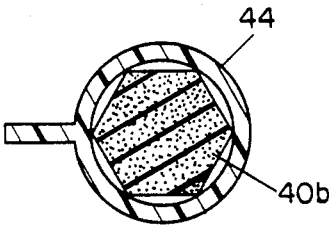
FIG. 6 is a cross-sectional view of the FIG. 5 element enclosing a hexagonal foam cylinder.

Referring now to FIGS. 4–11, there are shown alternative forms of components which may be used in pool covers in accordance with the present invention. FIG. 4 is a cross-sectional view of a cylindrical foam member 40*a* similar to foam cylinder 40 in FIG. 3, except that 40*a* is solid rather than hollow in cross section. FIG. 5 is a cross-sectional view of a safety edge element 44 extruded from a suitable plastic material in the form of a hollow extended tube with an integrally formed laterally extending rib. The FIG. 5 element 44 has the same basic shape as fabric means 42 in FIG. 3 after placement around cylinder 40, with an important difference. Element 44 can be used b itself, the circular portion being employed as resilient compressible means and the lateral extended rib portion being employed as support means for attachment to the edge of the cover fabric of a pool cover. Alternatively, depending on the type and characteristics of the material used to form the extruded element shown in cross-sectional view in FIG. 5, a rod or cylinder of compressible material of any desired cross-section, whether of circular, hexagonal or other shape, can be added as shown in FIG. 6, which includes a cylinder 40*b* of hexagonal cross-section.

Figure 7:
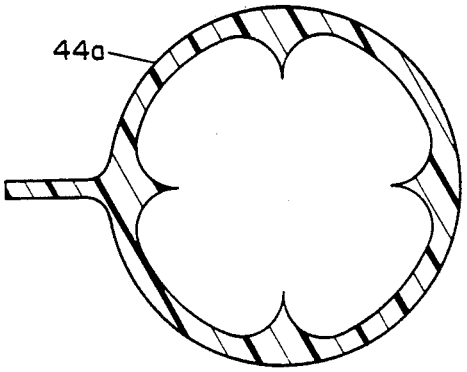
FIGS. 7 and 8 are cross-sectional views of alternative forms of extruded elements having internal ridges.
Figure 10:
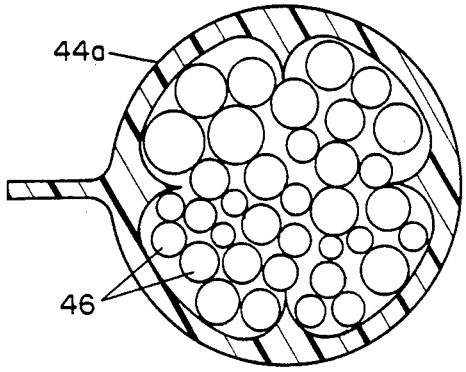
FIGS. 9 and 10 are cross-sectional views of the FIG. 7 element enclosing a square foam cylinder and a plurality of small foam spheres, respectively.
Figure 8:
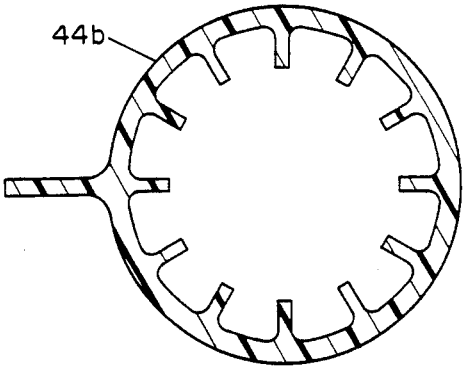
Figure 11:
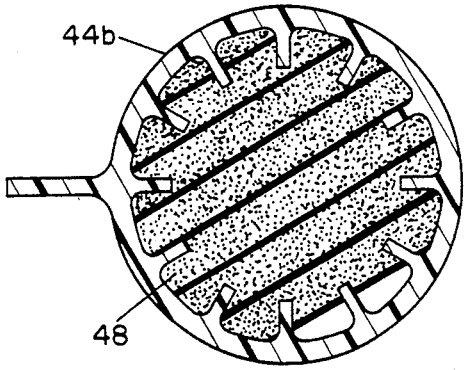
FIG. 11 is a cross-sectional view of the FIG. 8 element after formation of foam material filling its interior opening.
Figure 9:
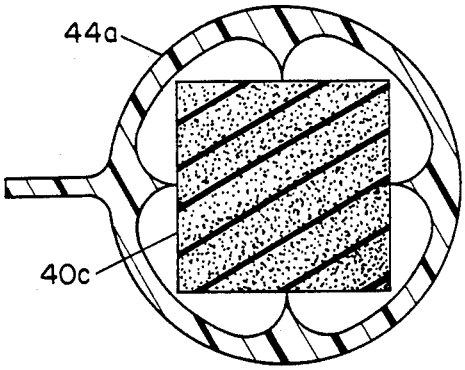

In use of extruded plastic elements, it may be found desirable to provide integral stiffening, such as by the inclusion of shaped internal ridges, examples of which are shown in the cross-sectional views of the extruded elements 44*a* and 44*b* in FIGS. 7 and 8, respectively. To illustrate additional safety edge embodiments which may be selected by workers skilled in the art, FIGS. 9 and 10 show use of the FIG. 7 element with the addition of a foam cylinder of square cross-section in FIG. 9 and the addition of spherical or irregularly shaped balls or pellets in FIG. 10. As an alternative, foam material may be formed within an extruded plastic element so as to fill it as shown in FIG. 11.

In installation of extruded plastic channel members such as shown in FIGS. 5–11, the channel can be cut to fit as the support means 42 fits in FIG. 3. The channel can then be attached by stitching along the lateral extended portion and flattening the ends and stitching across the channel so as to effectively stitch across the flattened ends along webbing strips 18*a* and *b* in the FIG. 3 example. If an internal compressible member is used it will normally be desirable to cut it to a shorter length than the outside supporting member, as shown in FIG. 3 by the dotted outline of cylinder 40 which ends short of the webbing strips 18*a* and *b* so as not to interfere with the stitching of the outside element to the webbing strips. It will also be understood that while the internal cylinders, rods, spheres, etc. have been described as being made of a foam material, in other applications it may be desirable to use other materials as may be selected by those skilled in the art once the invention is understood.

While the best mode currently contemplated for implementing the invention utilizes the low density hollow foam core with a tough, puncture resistant, and weather and abrasion resistant polymeric coated flexible fabric cover construction shown in FIG. 3, other materials may be used. The foamed core may have different shapes as discussed above and can be made from any number of water proof and pool chemical resistant plastic or synthetic rubbers which are blown (expanded) in closed-cell (unicellular) extrusions through the incorporation of chemical blowing agents, e.g. Uniroyal's Celogen®. As the core material will normally be protected from deteriorating environmental conditions, such as sunlight, by the wrapper sheeting, the core can be made from low cost plastics such as polyethylene or polypropylene or rubbers such as SBR (styrene-butadiene) or even reclaim rubbers. The supporting cover material is subjected to severe environmental conditions, mechanical abuse and high stresses and can desirably be constructed of a close-woven high strength fabric, coated on both sides with a high quality synthetic rubber which has the required mechanical, chemical and thermal characteristics. Although a number of high cost, special purpose rubbers such as Hypalon®, etc. which meet such demands, could be used, cost considerations narrow the choice to such materials as DuPont's Neoprene® (polychloroprene), Uniroyal's Royalene® (ethylenepropylene rubber) or Monsanto's Santoprene®, (thermoplastic polypropylene plastic-ethylene-propylene rubber blend).

While there have been described what are believed to be the preferred embodiments of the invention, those skilled in the art will recognize that other and further modifications and variations may be made thereto without departing from the invention and it is intended to claim all such changes and modifications as fall within the full scope of the invention.

I claim:

1. A pool cover, having a compressible safety edge for resiliently filling openings adjacent to vertical obstructions, comprising:

a flexible air and water permeable cover configured to cover a pool in secure overlapping relationship to pool edges except in the vicinity of an obstruction which prevents such overlapping along a portion of the edge of said cover;

resilient compressible means, conformable to an obstruction, for resiliently filling the interface between the edge of said cover and an obstruction of regular or irregular shape so as to leave only limited openings;

support means, configured for attachment to the edge of said cover, for supporting said resilient means at said non-overlapping portion of said edge; and fastening means, attached to said cover, for holding the pool cover in place over a pool and holding said resilient means and support means in place adjoining said obstruction;

whereby, upon installation of the pool cover the safety edge is held in place adjacent to an obstruction so as to resiliently secure the interface between the pool cover and the obstruction during both static conditions and loading conditions tending to separate the cover from said obstruction.

2. A pool cover as in claim 1, wherein said resilient compressible means comprises an elongated hollow cylindrical member formed of a resilient, low-density, polymeric closed-cell foam, light enough to float on water.

3. A pool cover as in claim 2, wherein said support means comprises a section of weather and abrasion resistant, polymer-coated fabric sheeting attached to the edge of said flexible cover so as to enclose and protect said compressible resilient means.

4. A pool cover as in claim 1, wherein said resilient compressible means comprises an elongated cylindrical member of regular geometric cross-section formed of a resilient, low-density, polymeric closed-cell foam, light enough to float on water.

5. A pool cover as in claim 4, wherein said support means comprises a section of weather and abrasion resistant, polymer-coated fabric sheeting attached to the edge of said flexible cover so as to enclose and protect said compressible resilient means.

6. A pool cover as in claim 1, wherein said support means comprises a section of weather and abrasion resistant, polymer-coated fabric sheeting attached to the edge of said flexible cover so as to enclose and protect said compressible resilient means.

7. A pool cover as in claim 1, wherein said resilient compressible means and support means comprise a hollow extruded plastic tube and an integrally formed laterally extending rib configured for attachment to the edge of said cover.

8. A pool cover as in claim 7, wherein said extruded plastic tube additionally comprises a plurality of internally extending ridges configured in view of desired resiliency and compressibility characteristics of said safety edge.

9. A pool cover as in claim 8, wherein said resilient compressible means and support means additionally comprise an elongated cylindrical member of regular geometric cross-section formed of resilient foam material existing within said extruded plastic tube.

10. A pool cover as in claim 7, wherein said resilient compressible means and support means additionally comprise an elongated cylindrical member of regular geometric cross-section formed of resilient foam material existing within said extruded plastic tube.

11. A pool cover as in claim 1, wherein said fastening means comprises webbing strips attached to said flexible cover and compression spring assemblies connected to said strips for coupling to poolside anchor points so as to urge the safety edge against an obstruction.

12. A swimming pool safety system, utilizing a pool cover with a compliant safety edge for resiliently securing openings adjacent to vertical obstructions, comprising:

a flexible mesh cover configured to cover a pool in secure overlapping relationship to pool edges except in the vicinity of an obstruction;

webbing strips attached to said cover transversely and at edges;

anchor means, fastened to the surface surrounding a pool, for anchoring said cover;

spring means, for coupling said webbing strips to said anchor means, for stretching the pool cover over a pool;

resilient compressible foam means, conformable to an obstruction, for resiliently securing the opening between the edge of said cover and an obstruction of regular or irregular shape; and support means, configured for attachment to the edge of said cover, for enclosing, protecting and supporting said resilient means;

whereby, upon installation of the pool cover the safety edge is held in place against an obstruction by said spring and anchor means so as to resiliently secure the opening between the pool cover and the obstruction during both static conditions and loading conditions tending to separate the cover from said obstruction.

13. A swimming pool safety system as in claim 12, wherein said resilient foam means comprises a section of a hollow cylinder formed of a resilient, light-weight, low-density, polymeric closed-cell foam.

14. A swimming pool safety system as in claim 13, wherein said support means comprises a section of weather and abrasion resistant, polymer-coated fabric sheeting attached to said webbing strips at the edge of said flexible cover so as to enclose and protect said resilient foam means.

* * * * *